US009240097B2

(12) United States Patent
Cornell et al.

(10) Patent No.: US 9,240,097 B2
(45) Date of Patent: Jan. 19, 2016

(54) GAMING MACHINE HAVING FLEXIBLE MOUNT FOR TOWER LIGHT

(71) Applicant: WMS Gaming Inc., Waukegan, IL (US)

(72) Inventors: Bradley D. Cornell, LaGrange, IL (US); Miguel A. Vega, Chicago, IL (US); James E. Oatman, Arlington Heights, IL (US); Jesus O. Cervantes, Jr., Chicago, IL (US); Kristopher A. Kopriva, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 231 days.

(21) Appl. No.: 13/835,229

(22) Filed: Mar. 15, 2013

(65) Prior Publication Data

US 2014/0274374 A1 Sep. 18, 2014

(51) Int. Cl.
*G07F 17/32* (2006.01)

(52) U.S. Cl.
CPC ..... *G07F 17/3216* (2013.01); *G07F 17/3211* (2013.01)

(58) Field of Classification Search
USPC ..... 463/30, 31, 32, 40
See application file for complete search history.

(56) References Cited

U.S. PATENT DOCUMENTS

| | | | | |
|---|---|---|---|---|
| 2,297,851 | A | 10/1942 | Wyss, Jr. | 240/2 |
| 2,623,313 | A | 12/1952 | Fuchs | 40/130 |
| 3,868,671 | A | 2/1975 | Maguire et al. | 340/323 |
| 4,074,452 | A | 2/1978 | Bellinder | 40/571 |
| 4,457,580 | A | 7/1984 | Klose | 350/6.91 |
| 5,670,971 | A | 9/1997 | Tokimoto et al. | 345/31 |
| 5,748,157 | A | 5/1998 | Eason | 345/31 |
| 6,265,984 | B1 | 7/2001 | Molinaroli | 340/815.4 |
| 6,278,419 | B1 | 8/2001 | Malkin | 345/31 |
| 6,302,790 | B1 | 10/2001 | Brossard | 463/20 |
| 6,629,019 | B2 | 9/2003 | Legge et al. | 700/237 |
| 8,091,259 | B2 | 1/2012 | Heather et al. | 40/546 |
| 8,317,604 | B2 | 11/2012 | Wells | 463/25 |
| 2005/0090311 | A1 | 4/2005 | Allitt et al. | A63F 9/24 |
| 2008/0032781 | A1* | 2/2008 | Seelig et al. | 463/20 |
| 2008/0039213 | A1* | 2/2008 | Cornell et al. | 463/46 |
| 2011/0207530 | A1* | 8/2011 | Chudek et al. | 463/30 |

FOREIGN PATENT DOCUMENTS

| | | | | |
|---|---|---|---|---|
| AU | 2011211446 | A1 | 1/2011 | G07F 17/32 |
| DE | 202 080820 | | 8/2002 | G09F 9/00 |
| DE | 20 2005 0058682 | | 8/2005 | G09F 13/18 |
| WO | WO 03/049828 | A1 | 6/2003 | A63F 13/00 |

* cited by examiner

*Primary Examiner* — Paul A D'Agostino
*Assistant Examiner* — Brandon Gray
(74) *Attorney, Agent, or Firm* — Nixon Peabody LLP

(57) ABSTRACT

A gaming machine includes a cabinet having a topbox frame attached thereto and facing a player position in front of the gaming machine, and one or more display devices within the cabinet and configured to display a wagering game. The gaming machine further includes a tower light for indicating a status condition, and a conduit for mounting the tower light to the topbox frame. The conduit has a fixed end attached to the topbox frame and an adjustable end attached to the tower light. The adjustable end is movable to different positions to provide a line of sight for viewing the tower light.

18 Claims, 14 Drawing Sheets

GAMING MACHINE HAVING FLEXIBLE MOUNT FOR TOWER LIGHT

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a tower light adjustably mounted between different positions.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Traditionally, gaming machines operate under control of a processor that has been programmed to execute base games and bonus games in which reel arrays spin and stop to display symbol combinations in a display area. If winning combinations are achieved by the symbol combinations, awards are provided to the players.

Some gaming machines include a tower light for indicating a status of the gaming machine or a pending inquiry from a player. The tower light typically extends from the top of the gaming machine to provide a line of sight to casino staff.

SUMMARY OF THE INVENTION

According to one aspect of the present invention, a gaming machine includes a cabinet having a topbox frame attached thereto and facing a player position in front of the gaming machine, and one or more display devices within the cabinet and configured to display a wagering game. The gaming machine further includes a tower light for indicating a status condition, and a conduit for mounting the tower light to the topbox frame. The conduit has a fixed end attached to the topbox frame and an adjustable end attached to the tower light. The adjustable end is movable to different positions to provide a line of sight for viewing the tower light.

According to another aspect of the invention, a gaming system includes an observation position and a gaming terminal. The gaming terminal includes a cabinet frame facing a player position in front of the gaming machine, and one or more display devices within the cabinet and configured to display a wagering game. The gaming machine further includes a conduit having a first end mounted to the cabinet and a second end adjustable between a plurality of different positions including a first position and a second position. The first position is obscured from view relative to the observation position, the second position being viewable relative to the observation position. A tower light is mounted to the second end of the conduit.

According to yet another aspect of the invention, a gaming machine includes a cabinet frame facing a player position in front of the gaming machine, and one or more display devices within the cabinet and configured to display a wagering game. A tower light is adjustably mounted to the cabinet frame via a flexible conduit, the tower light being movable between different positions relative to the player position. The flexible conduit being fixed at one end to the cabinet frame in each of the different positions. The tower light is fixed to another end of the conduit in each of the different positions.

Additional aspects of the invention will be apparent to those of ordinary skill in the art in view of the detailed description of various embodiments, which is made with reference to the drawings, a brief description of which is provided below.

Figure 1:
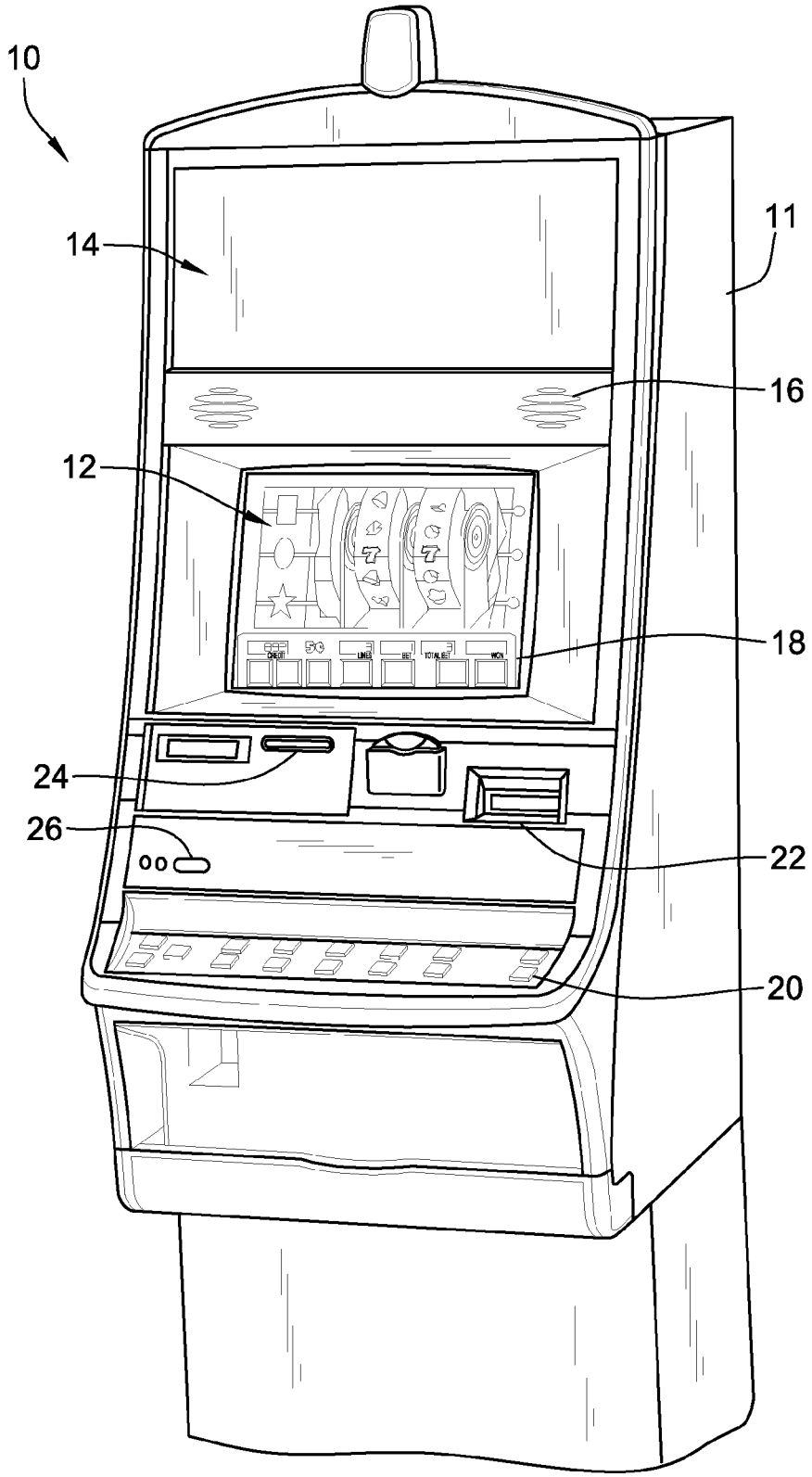
FIG. 1 (PRIOR ART)
FIG. 1 is a perspective view of a free-standing gaming terminal.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
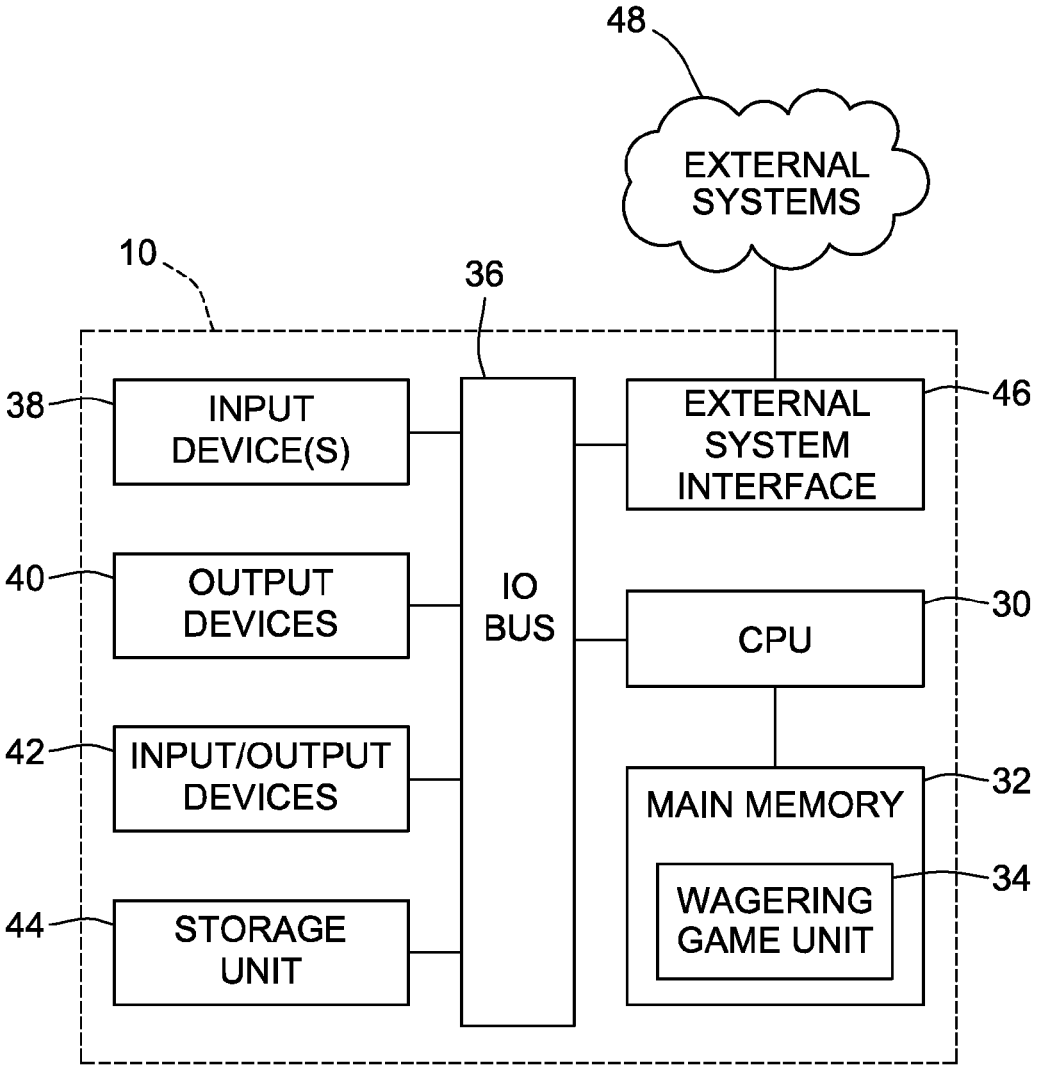
FIG. 2 (PRIOR ART)
FIG. 2 is a schematic view of a gaming system.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
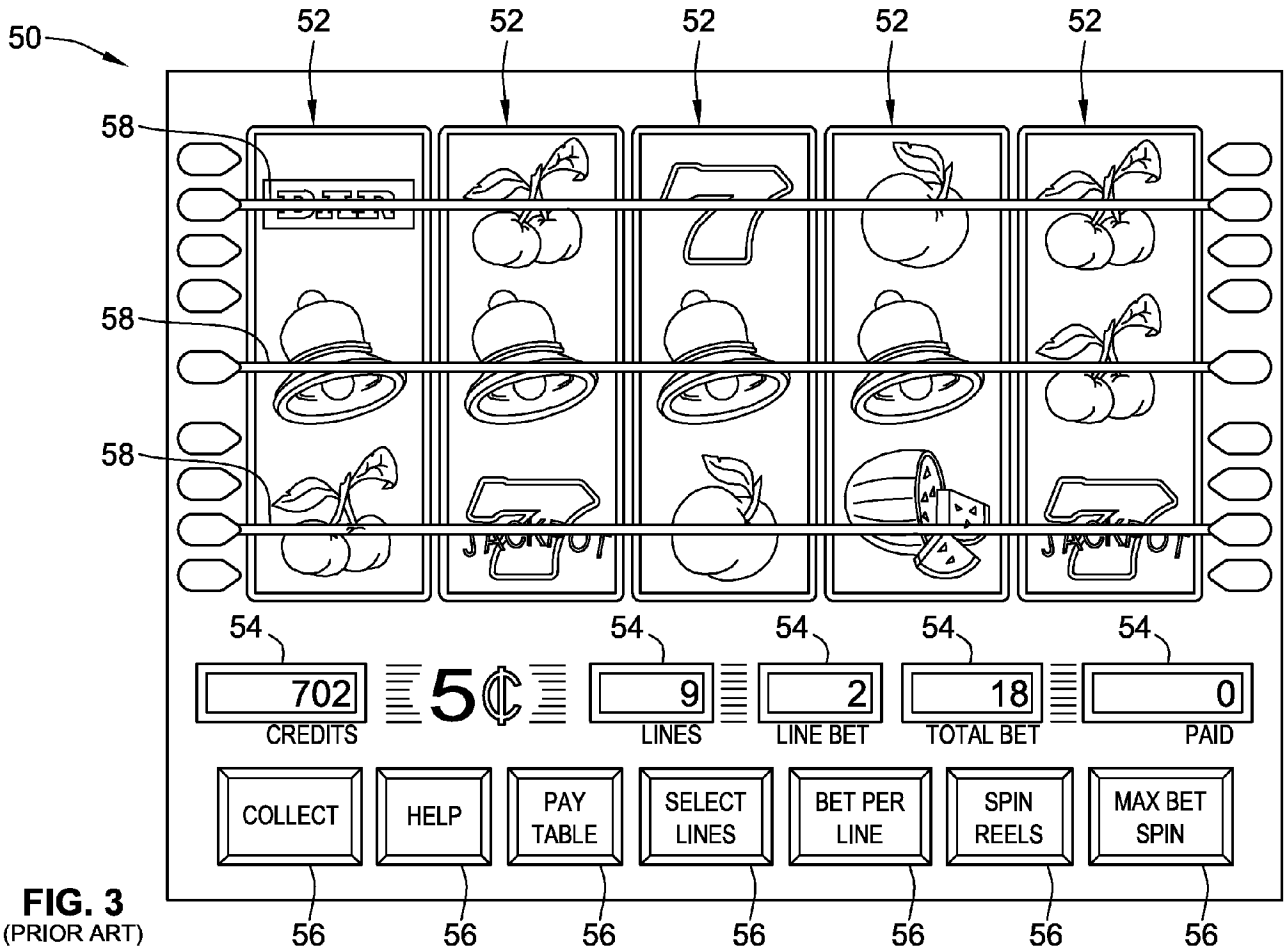
FIG. 3 (PRIOR ART)
FIG. 3 is an image of an exemplary basic-game screen of a wagering game displayed on a gaming terminal.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4A:
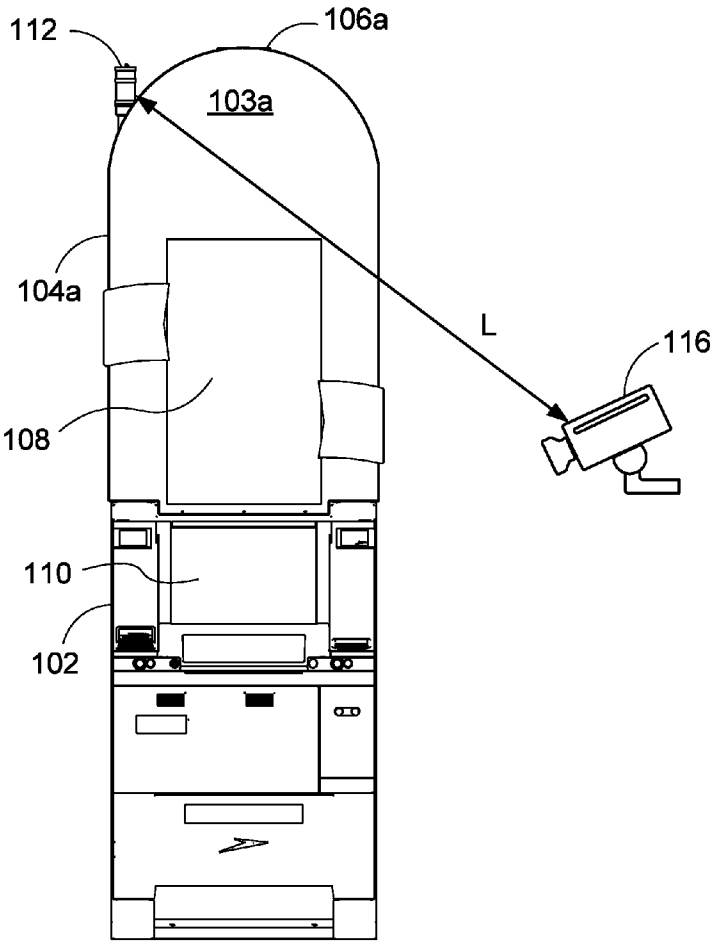
FIG. 4A (PRIOR ART)
FIG. 4A is a front elevation of a gaming terminal having a rounded topbox and a rigid tower light.
Figure 4B:
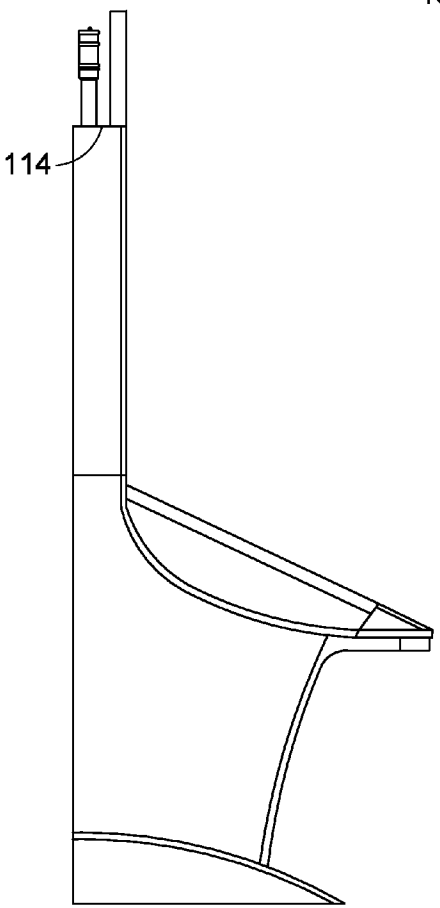
FIG. 4B (PRIOR ART)
FIG. 4B is a side elevation of the gaming terminal of FIG. 4A.

Referring now to FIGS. 4A and 4B, a gaming terminal 100 has a cabinet 102 with a rounded topbox 103 having a topbox frame 104*a* attached thereto facing a player position in front of the gaming terminal 100. The topbox frame 104*a* may be an independent unit from the cabinet 102 or can be part of the cabinet 102. The topbox frame 104 has a rounded top 106*a* and surrounds a top display device 108. The top display device 108 is located above a bottom display device 110 and within the cabinet 102. At least one of the display devices 108, 110 is configured to display a wagering game.

The gaming terminal 100 further includes a tower light 112 that is rigidly mounted to the topbox frame 104. Typically, the tower light 112 is mounted to an external surface 114 that is obscured from the view of a player in front of the gaming terminal 100. The tower light 112 indicates a status condition of the gaming terminal 100 to a staff of the casino. For example, the tower light 112 provides a status notification to indicate a malfunction or other problem associated with the gaming terminal 100 (e.g., warning status indicating that a main door of the gaming terminal is open, an abnormally large payout has been awarded, etc.).

The gaming terminal 100 is typically located on a floor of a gaming establishment, such as a casino, for wagering purposes. The position of the gaming terminal 100 is determined such that the tower light 112 has an unobstructed line of sight L to an observation position 116. The line of sight L is necessary to provide a clear visual display of any indications emitted by the tower light 112. For example, the line of sight L is between the tower light 112 and a security camera 116, which allows casino staff to quickly observe and readily initiate the required protocol to address any status alerts indicated by the tower light 112.

Figure 5A:
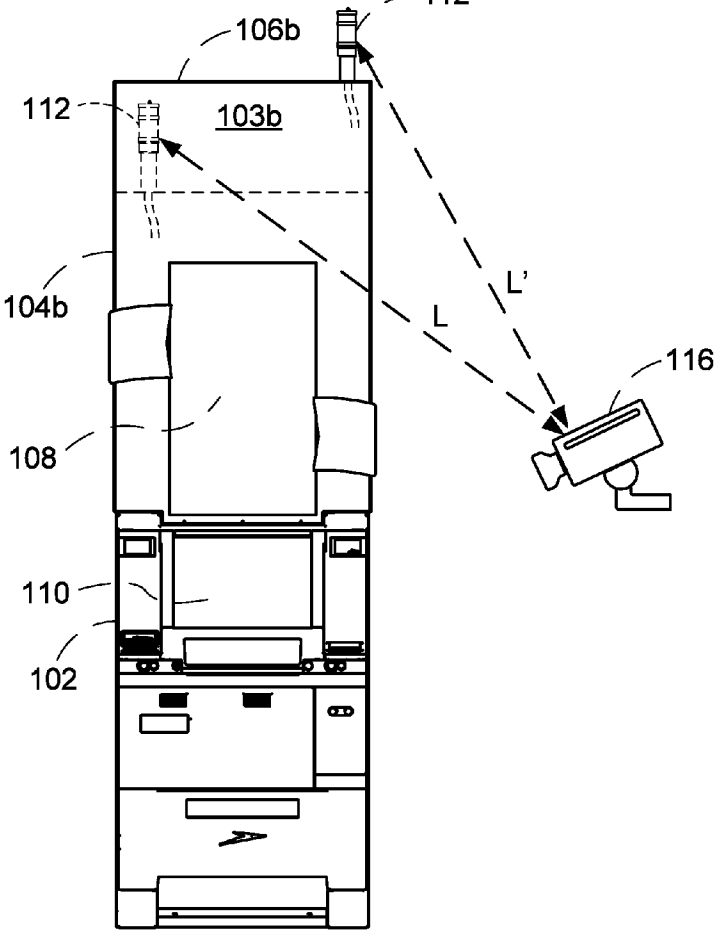
FIG. 5A (PRIOR ART)
FIG. 5A is a front elevation of the gaming terminal of FIG. 4A with a square topbox.
Figure 5B:
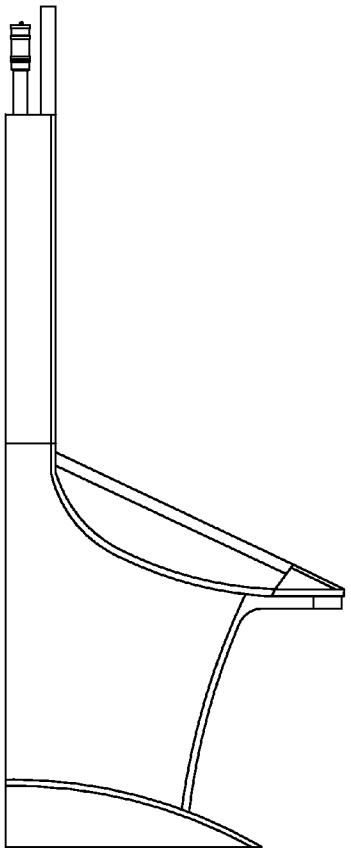
FIG. 5B (PRIOR ART)
FIG. 5B is a side elevation of the gaming terminal of FIG. 5A.

Depending on current needs of the casino, the gaming terminal 100 may require replacement of the current topbox 103*a* with a topbox of a different shape and/or size. For example, referring to FIGS. 5A and 5B, the rounded topbox 103*a* has been replaced with a square topbox 103*b*. Similar to the rounded topbox 103*a*, the square topbox 103*b* has a topbox frame 104*b* facing a player position in front of the gaming terminal 100. Furthermore, the topbox frame 104*b* has a square top 106*b* and surrounds the top display device 108. In another example, the gaming terminal 100 with the rounded topbox 103*a* is completely replaced by a gaming terminal with a square topbox.

In response to replacing the rounded topbox 103*a* with the square topbox 103*b*, the tower light 112 will be obscured from view in its current position relative to the security room 116. As such, the square shape of the square topbox 103*b* blocks the original line of sight L between the tower light 112 and the security camera 116.

A prior art, but disadvantageous, solution to this type of problem has been to completely remove and reattach the tower light 112 in a different position on the gaming terminal 100. For example, the tower light 112' would require to be remounted to a higher position on the cabinet 102 such that a new line of sight L' is reestablished between the tower light 112 and the security camera 116. This type of solution is disadvantageous at least because it requires additional work and/or additional components. For example, the installer is forced to unplug and reroute cables, use additional tools, use different brackets, etc. Adjustably-mounted tower lights are described below in reference to FIGS. 6-14 that are beneficial at least because new lines of sight can be established between the tower lights and observation points with minimal effort.

Figure 6:
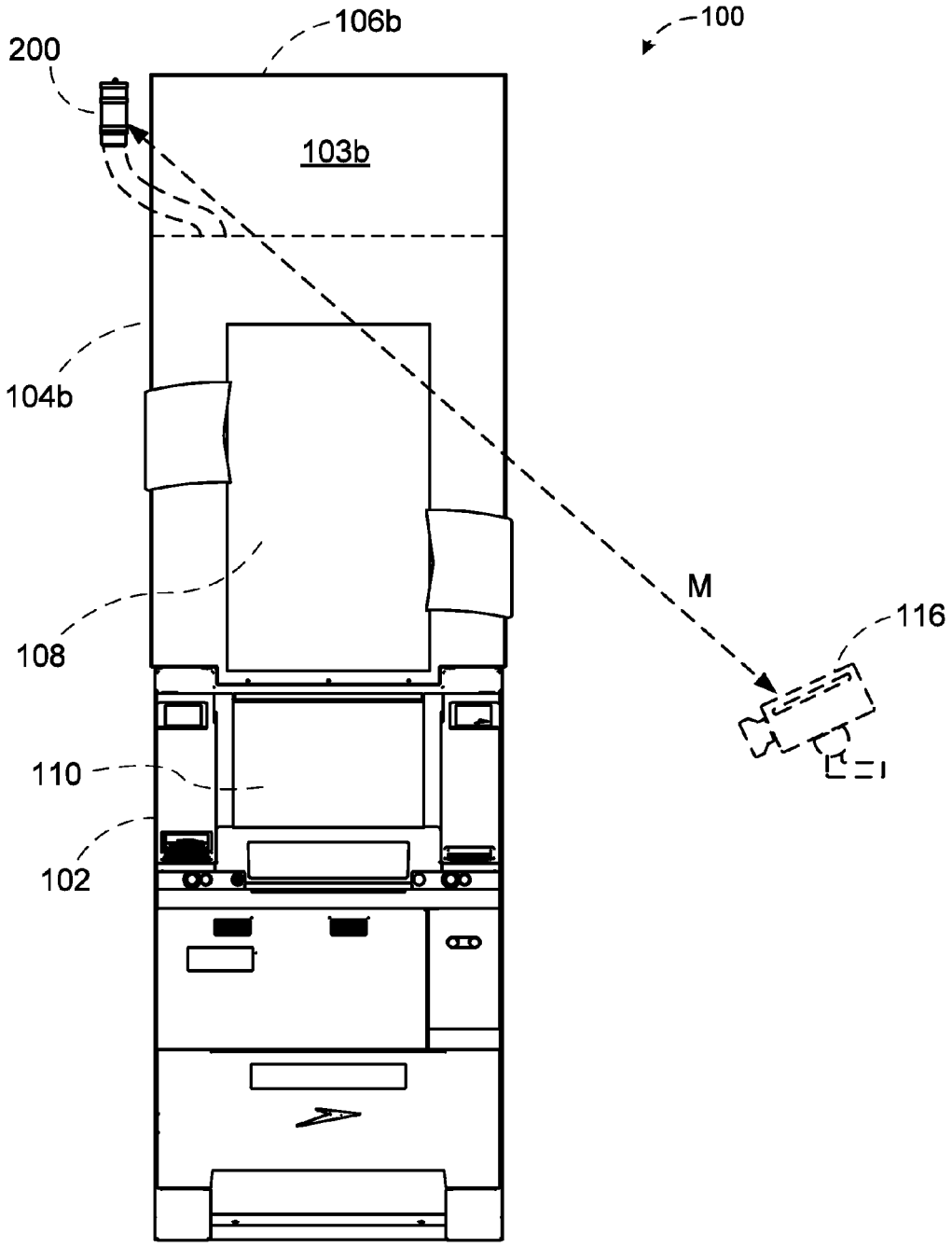
FIG. 6 is a front elevation of the gaming terminal of FIG. 5A with a flexible tower light.

Referring to FIG. 6, an adjustably-mounted tower light 200 replaces the rigidly-mounted tower light 112 described above. Specifically, as discussed in more detail below, the tower light 200 is adjustably mounted to the square topbox 103*b* such that a new light of sight M can be easily established between the tower light 200 and the security camera 116. The tower light 200 remains attached to the square topbox 103*b*, without requiring the additional work and/or components associated with the rigid tower light 112.

Figure 7:
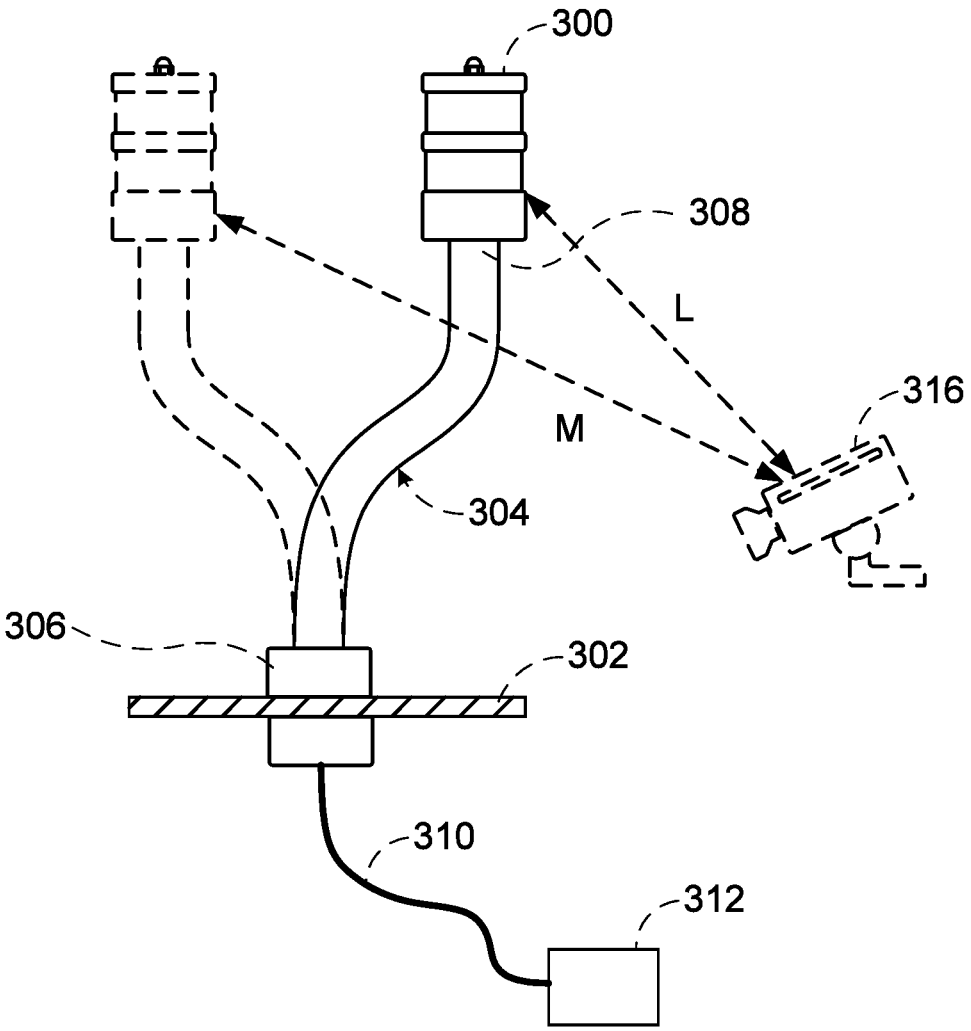
FIG. 7 is a front illustration of a formable tower light.

Referring to FIG. 7, a tower light 300 is mounted to a topbox frame 302 via a conduit 304. The conduit 304 has a fixed end 306 attached to the topbox frame 302 and an adjustable end 308 attached to the tower light 300. The adjustable end 308 is movable between different positions to provide a line of sight for viewing the tower light from an observation point, such as a security camera 316. For example, a line of sight L is established in a first position of the tower light 300 and a line of sight M is established in a second position of the tower light 300.

The fixed end 306 includes a coupler that fixes the conduit to the topbox frame 302. A cable 310 communicatively couples the tower light 300 to a power source 312 inside the topbox frame 302.

According to one example, the conduit 304 is an element that is formable by hand and retains its shape in each of the different positions. For example, the conduit 304 is a vinyl covered steel tubing that is sufficiently rigid to support the weight of the tower light 300 in each hand-adjusted position. One type of such products is available from Moffatt Products Inc. and includes "Moffatt Flex Arms" that are vinyl-covered spring steel arms of various strengths and sizes.

Figure 8:
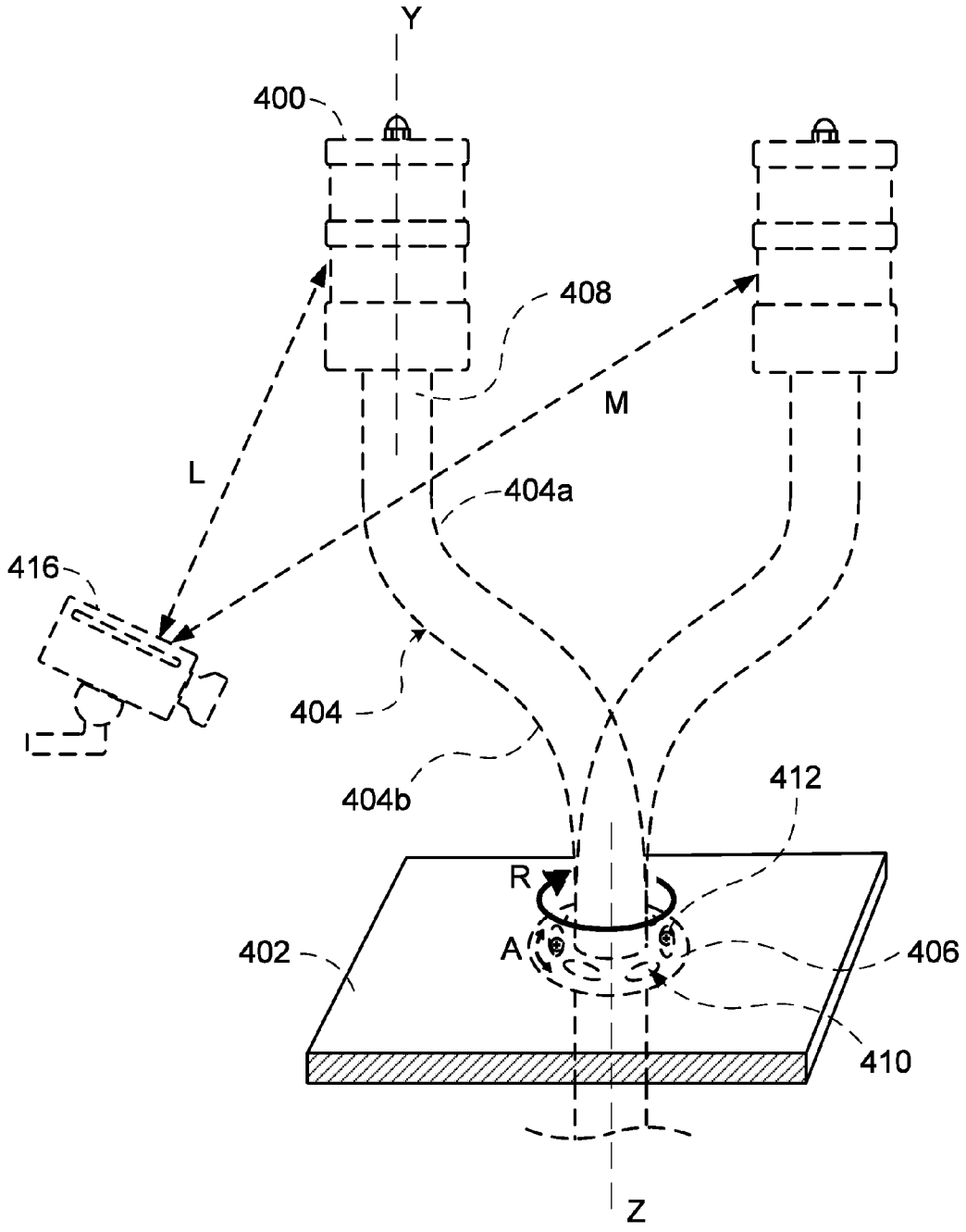
FIG. 8 is a front illustration of a tower light with a collar base.

Referring to FIG. 8, a tower light 400 is mounted to a topbox frame 402 via a conduit 404. The conduit 404 has a fixed end 406 attached to the topbox frame 402 and an adjustable end 408 attached to the tower light 400. The conduit 404 is a rigid tube with two bends 404*a*, 404*b* for offsetting a central axis Y of the tower light 400 relative to a central axis Z of the fixed end 406. The offsetting between the two axes Y, Z is helpful in providing a viewable position for the tower light 400.

The fixed end 406 includes a collar with radial slots 410 for multiple positions. For example, major adjustments R can be achieved by rotating the collar 406 in a clockwise direction from a first position, in which a first line of sight L is established with a security camera 416, to a second position, in which a second line of sight M is established with the security camera 416. Although the major adjustments R require removal of fasteners 412, internal cables do not require additional rerouting. Similarly, additional components are not required for the major adjustments R.

In another example, minor adjustments A can be achieved by adjusting the position of the slots 410 without the removal of the fasteners 412. The fasteners 412 are loosely connected while the appropriate position is determined and fixed.

Figure 9:
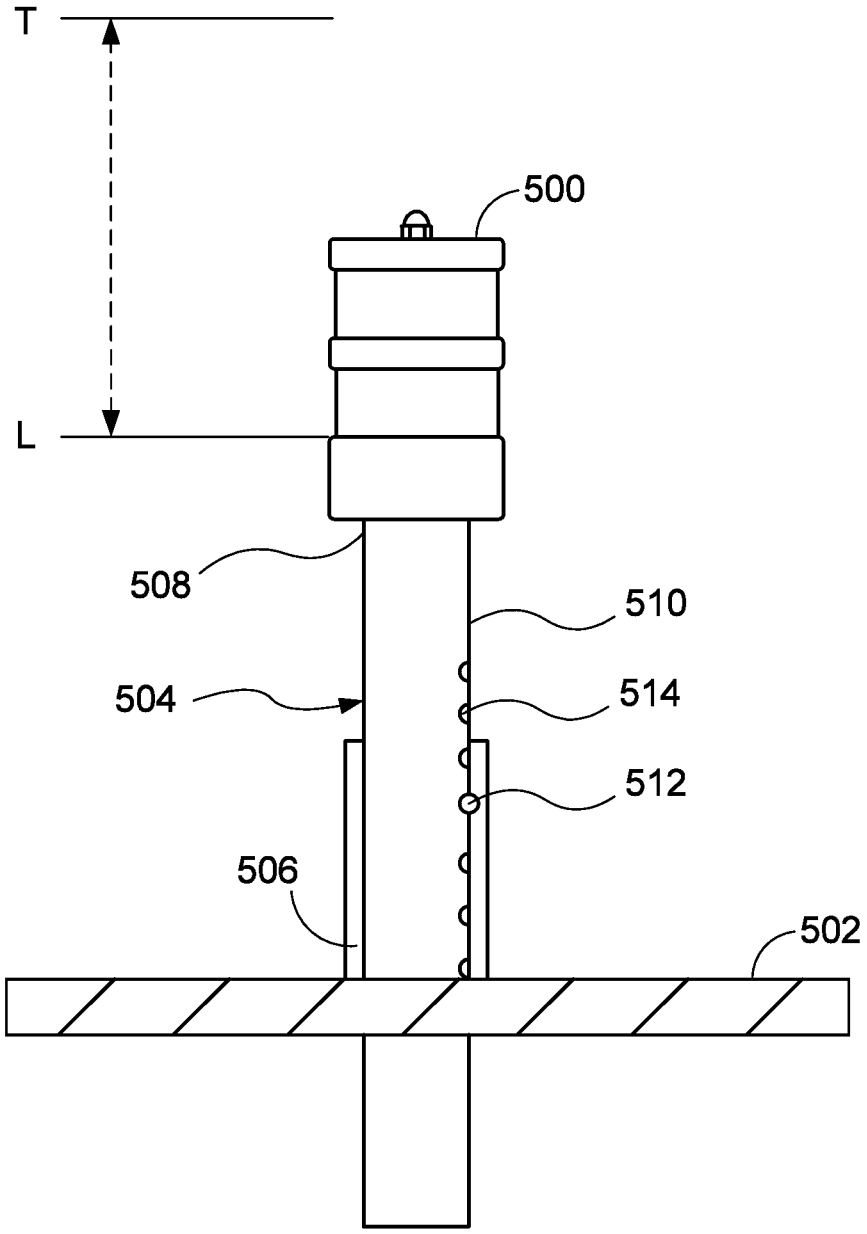
FIG. 9 is a front illustration of a tower light with a ball-locking feature.

Referring to FIG. 9, a tower light 500 is mounted to a topbox frame 502 via a conduit 504. The conduit 504 has a fixed end 506 attached to the topbox frame 502 and an adjustable end 508 attached to the tower light 500. The conduit 504 is an adjustable tube 510 with a ball locking feature, which includes a locking ball 512 and receiving holes 514. The tube 510 is adjustable between different positions by inserting the locking ball 512 (which has a spring force) into a corresponding hole 514.

The different positions vary vertically from a top position T to a low position L, with a lower end of the tube 510 being movable inside the topbox frame 502. To adjust the conduit 504, the locking ball 512 is disengaged from a current hole 514, the tube 510 is moved to a desired position, and the locking ball 512 is engaged in a new hole 514 corresponding to the desired position.

Figure 10B:
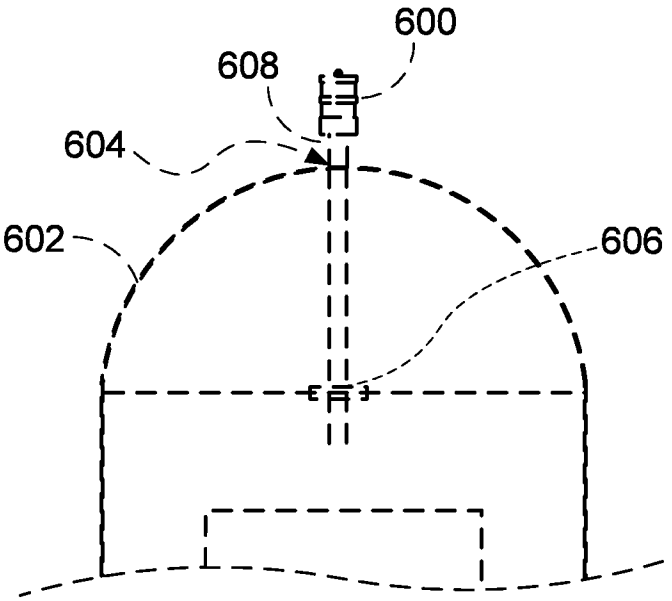
FIG. 10B illustrates the tower light of FIG. 10A in a viewable position.
Figure 10A:
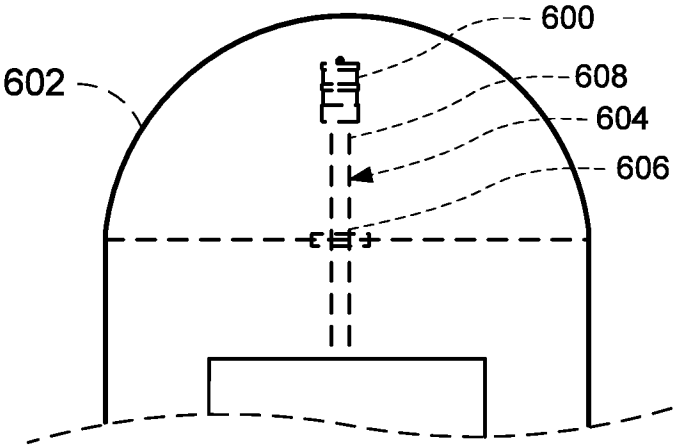
FIG. 10A is a front elevation of a gaming terminal with a tower light in an obscured position.

Referring to FIGS. 10A and 10B, a tower light 600 is mounted to a topbox frame 602 via a conduit 604. The conduit 604 has a fixed end 606 attached to the topbox frame 602 and an adjustable end 608 attached to the tower light 600. The tower light 600 is hidden from view until it is needed and, then, it pops up (e.g., spring-actuated). For example, in FIG.

10A, the tower light 600 is in an obscured position behind the topbox frame 602. In FIG. 10B, in response to a malfunction or other alert condition, the tower light 600 automatically moves to a viewable position. After the alert condition has been cleared, the tower light 600 can be moved back to the obscured position.

Figure 11:
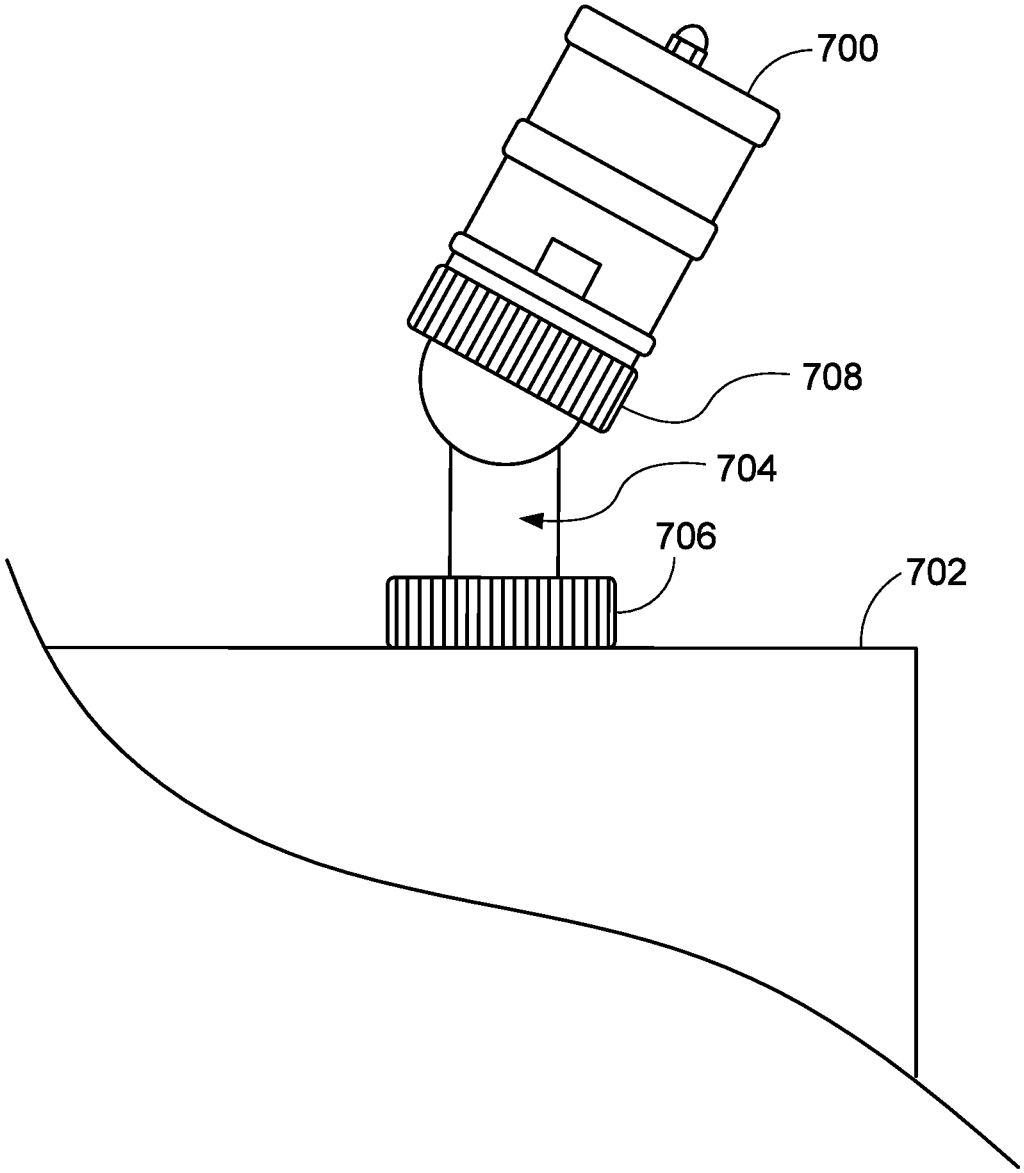
FIG. 11 illustrates a tower light mounted on a universal joint.

Referring to FIG. 11, a tower light 700 is mounted to a topbox frame 702 via a conduit 704. The conduit 704 has a fixed end 706 attached to the topbox frame 702 and an adjustable end 708 attached to the tower light 700. The adjustable end 708 of the conduit 704 is a universal joint that allows multiple degrees of freedom for the adjustable end 708. As such, the tower light 700 can be rotated in multiple directions for visibility purposes. Alternatively, the fixed end 706 can be a universal joint.

Figure 12:
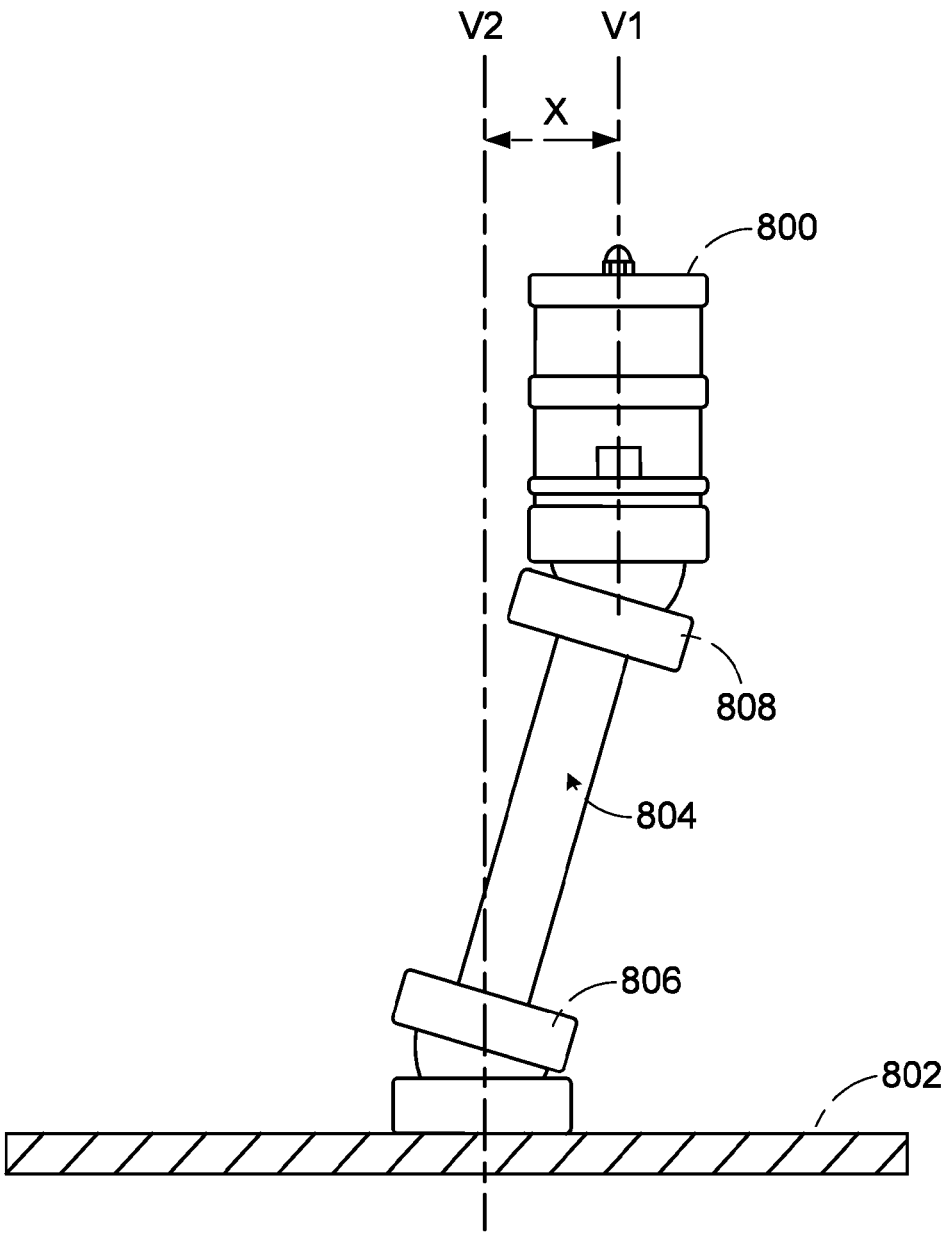
FIG. 12 is a front illustration of a tower light with multiple universal joints.

Referring to FIG. 12, a tower light 800 is mounted to a topbox frame 802 via a conduit 804. The conduit 804 has a fixed end 806 attached to the topbox frame 802 and an adjustable end 808 attached to the tower light 800. The adjustable end 808 of the conduit 804 is a universal joint that allows multiple degrees of freedom for the adjustable end 808. Similarly, the fixed end 806 is also a universal joint that allows multiple degrees of freedom near the lower end of the conduit 804. As such, the tower light 700 can be rotated in multiple directions for visibility purposes, both at the adjustable end 808 and near the fixed end 806. For example, the tower light 800 can be adjusted to be vertically aligned with a central axis V1 (of the adjustable end 808) such that the adjustable end 808 is offset relative to a central axis V2 (of the fixed end 806) at a distance X.

Figure 13B:
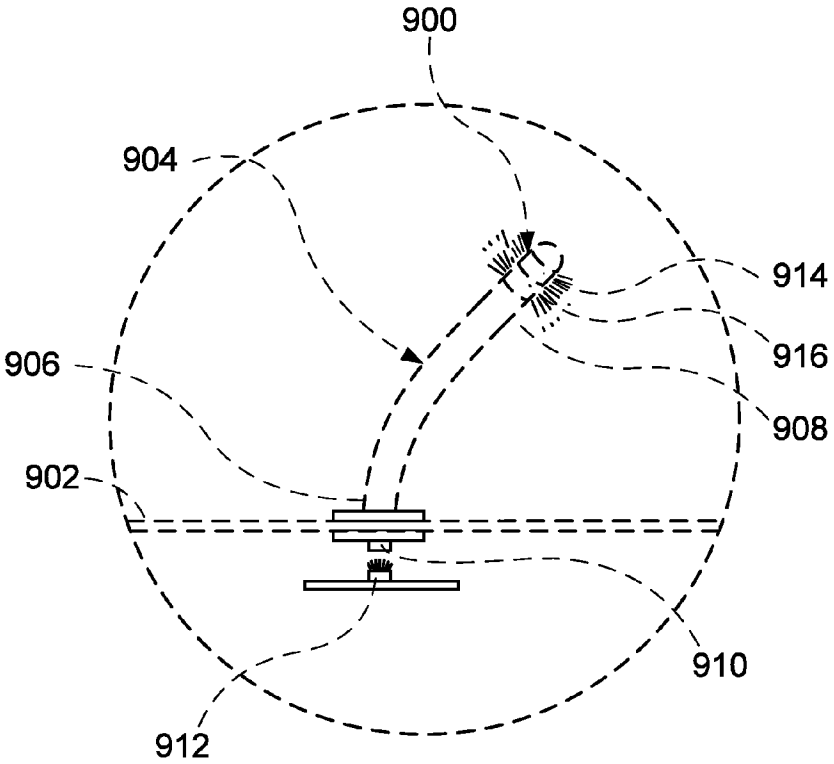
FIG. 13B is an enlarged illustration of the tower light of FIG. 12A.
Figure 13A:
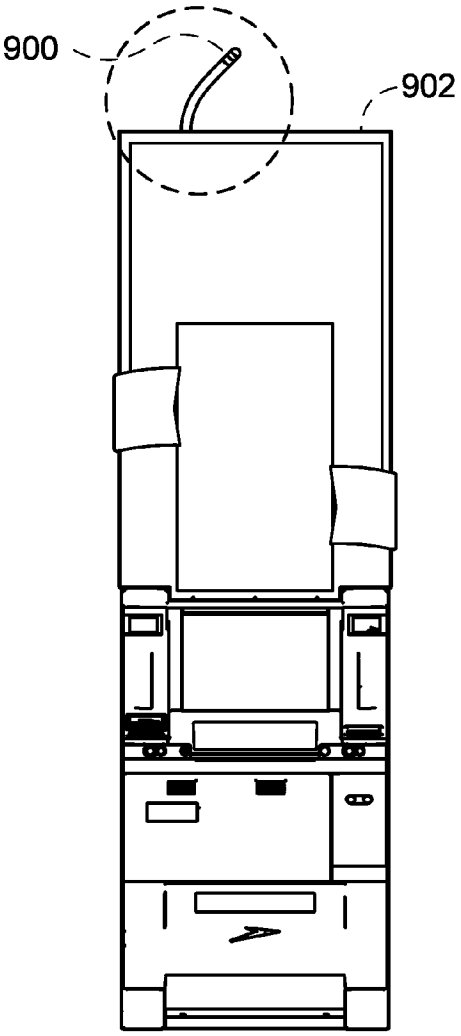
FIG. 13A is a front elevation of a gaming terminal with an illuminated tower light.

Referring to FIGS. 13A and 13B, a tower light 900 is mounted to a topbox frame 902 via a conduit 904. The conduit 904 has a fixed end 906 attached to the topbox frame 902 and an adjustable end 908 attached to the tower light 900. The conduit 904 is a flexibly positional shaft through which one or more fiber optic cables 910 transmit light from a light source 912 to one or more illuminated areas 914, 916. The light source 912 can be, for example, a light-emitting diode (LED) or an incandescent lighting fixture. The illuminated areas 914, 916 can emit different type of lighting, including, for example, brighter lighting in a first illuminated area 914 and a dimmer lighting in the second illuminated area 916.

Figure 14:
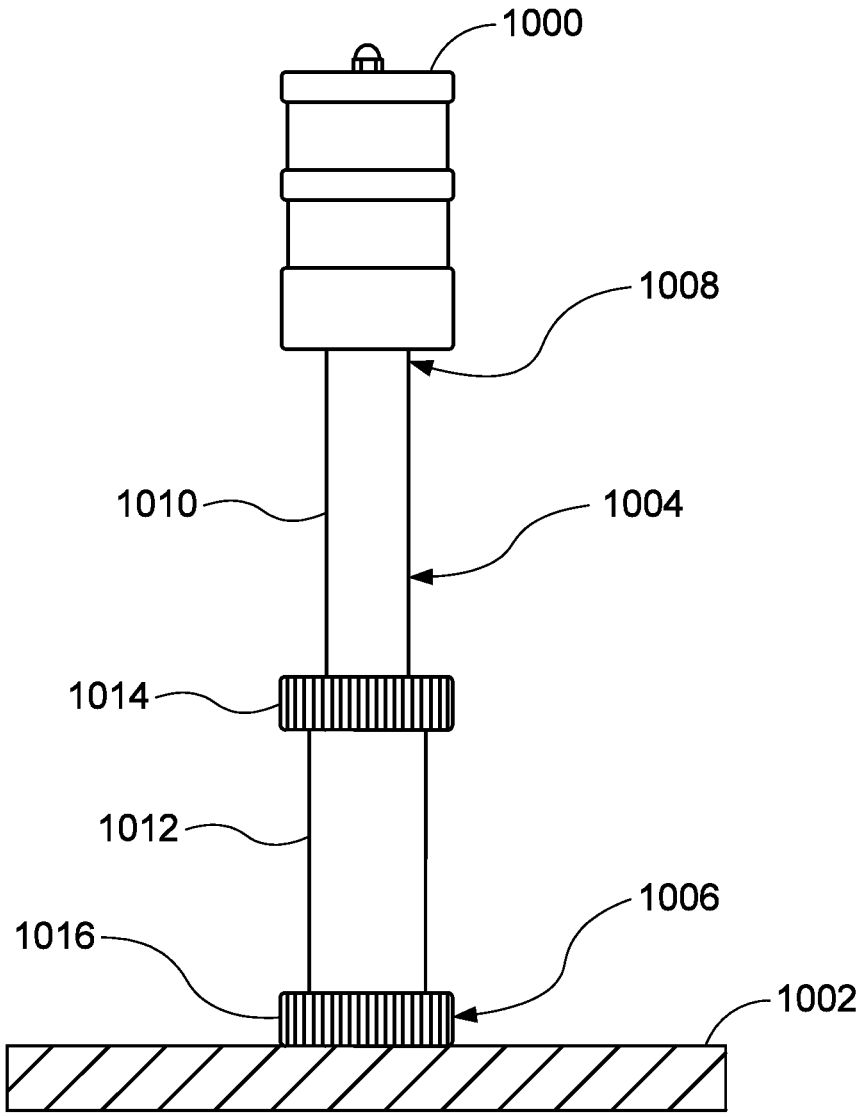
FIG. 14 is a front illustration of a tower light with twist collars.

Referring to FIG. 14, a tower light 1000 is mounted to a topbox frame 1002 via a conduit 1004. The conduit 1004 has a fixed end 1006 attached to the topbox frame 1002 and an adjustable end 1008 attached to the tower light 1000. The conduit 1004 is a telescoping post having a top member 1010 and a bottom member 1012. The top member 1010 has a smaller diameter than the bottom member 1012 and is slidably insertable within the bottom member 1012. Furthermore, the top member 1010 is fixed in place relative to the bottom member 1012 via a top twist collar 1014. Optionally, the bottom member 1012 is slidable relative to and within the topbox frame 1002. A bottom twist collar 1016 is used to fix the bottom member 1012 in place relative to the topbox frame 1002. Thus, the tower light 1000 can be adjusted up or down when at least one of the twist collars 1014, 1016 is in a loose or untightened position. When the desired position is achieved, the tower light 1000 is fixed in position by tightening the appropriate twist collars 1014, 1016.

Each of these embodiments and obvious variations thereof is contemplated as falling within the spirit and scope of the claimed invention, which is set forth in the following claims.

What is claimed is:

1. A gaming machine comprising:

a cabinet having a topbox frame attached thereto;

one or more display devices within the cabinet and configured to display a wagering game;

a tower light having a status indicator for indicating a status condition of the gaming machine to an observation point external to the gaming machine; and a conduit mounting the tower light to the topbox frame, the conduit having a fixed end attached to the topbox frame and an adjustable end attached to the tower light, the adjustable end being movable to different positions to provide a line of sight for viewing the tower light, the conduit being in the form of a flexibly positionable shaft with one or more illuminated areas near the adjustable end, the one or more illuminated areas receiving light from a light source located internally in the topbox frame.

2. The gaming machine of claim 1, wherein the conduit includes a formable element between the fixed end and the adjustable end, the formable element being bendable by a user to the different positions, the formable element retaining its shape in each of the different positions.

3. The gaming machine of claim 1, wherein the fixed end includes a bottom coupler fastened to a top exterior surface of the topbox frame, the conduit being electrically coupled to a cable fastened to a top interior surface of the topbox frame, the adjustable end including a top coupler fastened to the tower light.

4. The gaming machine of claim 1, wherein the conduit is a cylindrical tube with the adjustable end being offset from the fixed end along a center axis, the fixed end being fastened to the topbox frame via a collar base with radial slots for multiple tower light positions, the adjustable end being movable to the different positions by adjustably moving the radial slots.

5. The gaming machine of claim 1, wherein the conduit includes telescoping members movable relative to each other, the adjustable end being movable to the different positions by adjustably moving the telescoping members relative to each other.

6. The gaming machine of claim 5, wherein the telescoping members are locked relative to each other with a ball locking feature.

7. The gaming machine of claim 5, wherein the telescoping members are locked relative to each other with a twist collar.

8. The gaming machine of claim 1, wherein the different positions include an obscured position and a viewable position, the adjustable end automatically moving between the obscured position and the viewable position in response to a predetermined condition.

9. The gaming machine of claim 1, wherein the conduit includes one or more universal joints with multiple degrees of freedom.

10. The gaming machine of claim 9, wherein a first universal joint is located at the fixed end and a second universal joint is located near the adjustable end.

11. A gaming system comprising:

an observation position; and a gaming machine including a cabinet frame facing a player position in front of the gaming machine, one or more display devices within the cabinet and configured to display a wagering game, a conduit having a first end mounted to the cabinet and a second end adjustable between a plurality of different positions including a first position and a second position, the first position being obscured from view relative to the observation position, the second position being viewable relative to the observation position, the conduit being in the form of a flexibly positionable shaft with one or more illuminated areas near the adjustable end, the one or more illuminated areas receiving light from a light source located internally in the topbox frame, and a tower light mounted to the second end of the conduit and having a status indicator for indicating a status condition of the gaming machine to an observation point external to the gaming machine.

12. The gaming machine of claim 11, wherein the conduit is a cylindrical tube with the second end being offset from the fixed end along a center axis, the first end being fastened via a collar base with radial slots for multiple tower light positions, the second end being movable between positions of the plurality of different positions by adjustably moving the radial slots.

13. The gaming machine of claim 11, wherein the conduit includes telescoping members movable relative to each other, the second end being movable between positions of the plurality of different positions by adjustably moving the telescoping members relative to each other.

14. The gaming machine of claim 11, wherein the second end automatically moves between the first position and the second position in response to a predetermined condition.

15. The gaming machine of claim 11, wherein the conduit includes one or more universal joints with multiple degrees of freedom.

16. A gaming machine comprising:

a cabinet frame facing a player position in front of the gaming machine;

one or more display devices within the cabinet and configured to display a wagering game;

a tower light adjustably mounted to the cabinet frame via a flexible conduit, the tower light having a status indicator for indicating a status condition of the gaming machine to an observation point external to the gaming machine, the tower light being movable between different positions relative to the player position, the flexible conduit being fixed at one end to the cabinet frame in each of the different positions, the tower light being fixed to another end of the conduit in each of the different positions, the conduit being in the form of a flexibly positionable shaft with one or more illuminated areas near the adjustable end, the one or more illuminated areas receiving light from a light source located internally in the topbox frame.

17. The gaming machine of claim 16, wherein the tower light is viewable from the player position in one of the different positions, the tower light being obscured from view relative to the player position in another one of the different positions.

18. The gaming machine of claim 16, wherein the tower light is manually adjustable between the different positions.

* * * * *